United States Patent [19]

Webb et al.

[11] Patent Number: 4,545,444

[45] Date of Patent: Oct. 8, 1985

[54] JAR MECHANISM ENERGIZER

[76] Inventors: Derrel D. Webb, 802 Axilda, Houston, Tex. 77017; Edwin A. Anderson, 1104 Chimney Rock, Houston, Tex. 77056

[21] Appl. No.: 569,269

[22] Filed: Jan. 9, 1984

[51] Int. Cl.[4] ..... E21B 31/113

[52] U.S. Cl. ..... 175/296; 175/297; 175/300

[58] Field of Search ..... 175/297, 296, 300, 301, 175/302, 293

[56] References Cited

U.S. PATENT DOCUMENTS

| | | | |
|---|---|---|---|
| 2,265,431 | 12/1941 | Kerr | 175/297 |
| 2,801,078 | 7/1957 | Medders et al. | 175/297 |
| 2,896,917 | 7/1959 | McGarrahan | 175/297 |
| 3,880,249 | 4/1975 | Anderson | 175/302 |
| 4,226,289 | 10/1980 | Webb et al. | 175/297 |

*Primary Examiner*—James A. Leppink
*Assistant Examiner*—Hoang C. Dang
*Attorney, Agent, or Firm*—Jack W. Hayden

[57] ABSTRACT

An energizer for use with a jar mechanism incorporated on inner and outer bodies in a well string to assist the jar mechanism in delivering an upward jar to the well string includes longitudinally spaced seal means between the inner and outer bodies forming a chamber for receiving a compressible medium therein. A differential area formed on one of the bodies within the compressible medium chamber compresses a compressible medium in the chamber as the well string is lowered to position the inner and outer bodies so that the jar mechanism is actuated to restrain relative longitudinal movement between the inner and outer bodies to an extended position whereby a pull force may be developed in the well string in one of the bodies. The differential area is responsive to the compressed gas in the chamber to assist the jar mechanism in applying an upward jarring force when the jar mechanism, in response to a predetermined pull force in the well string, releases the bodies for contact to apply an upward force to the well string.

36 Claims, 10 Drawing Figures

JAR MECHANISM ENERGIZER

BACKGROUND OF THE INVENTION

1. Field of the Invention

The present invention relates to an arrangement for assisting in delivering an up jar blow by a jarring mechanism in a well string to unstick a fish, or stuck element, in a well bore.

2. Description of the Prior Art

The most pertinent prior patents with which Applicants are familiar are U.S. Pat. Nos. 2,265,431 issued to R. L. Kerr on Dec. 9, 1941 and 2,801,078 issued to W. L. Medders et al on July 30, 1957. Kerr and Medders each disclose an independent piston arrangement which is connected with a hydraulic jar and which piston arrangement may be moved to compress gas in a chamber as the jar mechanism is actuated to enable a pull force to be developed in a well string. However, only the compressed gas in each patent is utilized to unlock the jar means whereby the piston in response to the compressed gas may then move upwardly and deliver a jarring blow to the well string. It can be appreciated that some of the energy of the compressed gas in each of the above referenced patents is utilized to actuate and effect release of the jar mechanism, whereas the instant invention is constructed and arranged so that the jar mechanism is externally controlled in that the well string is directly connected mechanically with the jar mechanism. Thus, the jar mechanism is engaged by manipulation of the well string so that a pull force may then be developed in the well string by manipulation thereof to build up energy in the well string which is utilized for applying a jar blow when the jar mechanism releases in response to the pull force. Thus, the mass in the Medders et al and Kerr Patents that is involved in the impact to the well string is confined to the internal structure of the tool. On the other hand, in the instant invention, the mass involved in the impact is not confined to the internal structure of the tool, but is external and can be varied. Accordingly, in each prior patent if the mass is constant and the pressure of the charge gas is constant, then the impact is constant; whereas, in the instant invention, the mass may be varied and even with a constant gas pressure, the impact can be varied externally of the tool at the selection or control of the operator.

Also, in the Medders et al structure as well as in the Kerr patent, varying the mass above the tool can have no effect in increasing the energy employed in the impact. On the other hand, increasing the mass above the tool in the prior art can detract or diminish the impact blow; whereas, in the present invention, an increase in mass above the tool increases the impact blow. Neither patent discloses an arrangement to neutralize the hydrostatic head in the well bore acting on the jar mechanism or means to neutralize the hydrostatic head of the well bore acting on the compressed gas chamber.

Further, each preferably provides a piston arrangement which sealably engages with a cylinder so that movement of the piston in response to the gas pressure must overcome such frictional engagement.

SUMMARY OF THE INVENTION

In the present invention, the well string is mechanically connected with the jar mechanism to effect release thereof by developing a pull in the well string, and is mechanically or hydraulically connected with the energizer so that the amount of pull on the well string and jar is involved in the dynamic impact that may be applied by the jarring mechanism and the energizer arrangement of the present invention.

An object of the present invention is to provide a device for use with a jar mechanism on inner and outer bodies in a well string to assist in delivering a upward jar to the well string including longitudinally spaced seal means between the inner and outer bodies forming a chamber for receiving a compressible medium therein and means forming a differential area on one of the bodies within the compressible medium chamber which compresses the compressible medium in the chamber as the well string is lowered to position the inner and outer bodies so that the jar mechanism is actuated to restrain relative longitudinal movement between the inner and outer bodies to an extended position whereby a pull force may be developed in well string and one of the bodies whereupon the jar mechanism, in response to the pull force, releases the bodies for unrestrained relative movement and jarring contact to apply an upward jar force to the well string, said differential area responsive to the compressed gas in the chamber to exert an upward force thereon to assist in applying the upward jar to the well string when the inner and outer bodies are released in response to the pull force.

Yet a further object of the present invention is to provide a gas assisted hydraulic or mechanical jar for a well string wherein the mass above the tool may be varied to enable the operator to selectively vary and control the jar blow to enhance the energy applied during the jarring impact.

A further object of the present invention is to enhance the energy available from a jar mechanism in a well string by storing energy as the jar mechanism is cocked, which energy is over and above that which is generated by a mechanical or hydraulic force in the well string.

Other objects and advantages of the present invention will become apparent from a consideration of the following drawings and description wherein:

DESCRIPTION OF THE PREFERRED EMBODIMENTS

Figure 3:
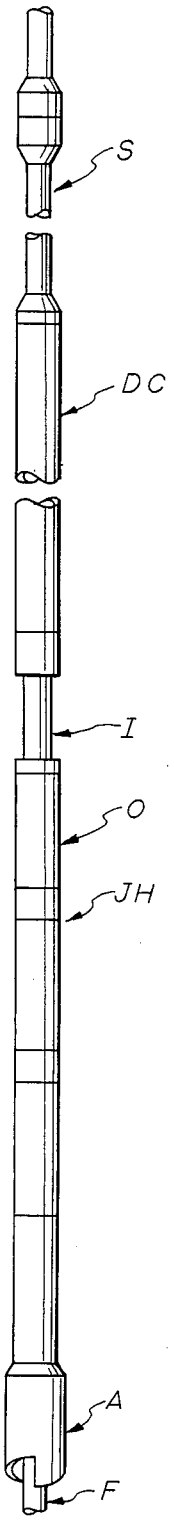
FIG. 3 is an elevational view illustrating the arrangement and relationship of a jar mechanism incorporating the present invention in a well string for use in a well bore.
Figure 4:
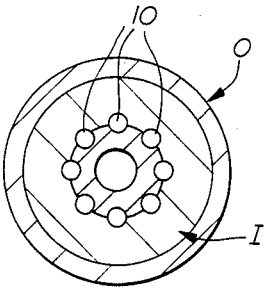
FIG. 4 is a vertical cross-sectional view on the line 4—4 of FIG. 1A and illustrating in greater detail an arrangement for locking the inner and outer bodies of a jar mechanism against relative rotational movement, while accommodating relative longitudinal movement therebetween.
Figure 5:
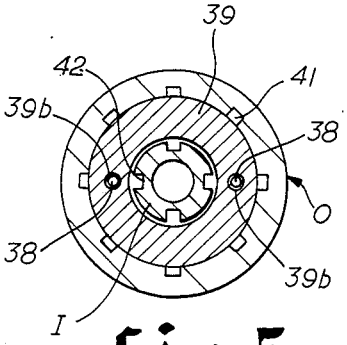
FIG. 5 is a sectional view on the line 5—5 of FIG. 1B and illustrates in greater detail one specific embodiment of a hydraulic jar arrangement on the inner and outer bodies.

Attention is first directed to FIG. 3 of the drawings wherein the lower end of a pipe fishing string, or well string, is indicated generally by the letter S with drill collars DC forming part thereof and connected to the lower end thereof and depending therefrom. A jar mechanism of any suitable type and construction includes cooperating means formed on an inner body referred to by the letter I which is shown as being connected to the lower end of the drill collar portion of the well string S and the inner body I is telescopically received in an outer body O for longitudinal movement relative therebetween for delivering an upward jar impact to the well string and to a fishing tool attachment A which is secured to a fish or stuck well element F in the well bore. The fishing tool attachment A is shown as connected to the outer body O.

The inner body I may be formed of a hollow tubular member as shown in the drawings and the outer body O provides an outer housing as shown in the drawings.

The present invention will be described in connection with a specific structural hydraulic jar arrangement designated JH and a specific mechanical jar arrangement designated JM; however, it should be appreciated and understood that such description is for purposes of explanation only. The present invention may be used with any type jar, that is, hydraulic or mechanical, regardless of the specific arrangement of the internal components of such jar mechanism. Further, although the invention will be described wherein the jar mechanism JH is constructed and arranged so that the inner body I thereof is connected to the lower end of a well string S, it will be appreciated and understood that the jar mechanism could be constructed and arranged so that the outer body O is connected to the lower end of the well string beneath the drill collars DC and the inner body I is connected with the fishing tool attachment referred to by the letter A and the stuck fish F for delivering an upward jar thereto as will be explained.

Also, the components of the invention shown in the drawings may be reversed, that is, the components on the inner body may be carried on the outer body and the components on the outer body may be mounted on the inner body.

The invention is illustrated in FIGS. 1A–2 and 4–7 inclusive as being employed with a hydraulic jar mechanism referred to by the letter JH in the drawings. The jar JH includes the inner body I which is telescopically received in the outer body O as illustrated in the drawings.

The inner body I includes longitudinally extending and circumferentially spaced grooves or recesses 10 which receive the pins or keys 11 on outer body O which accommodate relative longitudinal movement between the inner body I and outer body O while preventing relative rotational movement therebetween.

Longitudinally spaced upper and lower seal means 15, 16 between inner body I and outer body O form first chamber means 18 for receiving operating liquid therein for operation of the jar JH as will be described in greater detail.

As previously noted, the drawings, by way of example only and not by way of limitation, illustrate the inner body I as being connected to the lower end of the well string S, and to this end, suitable threads as shown at 9 are provided on the inner body I for such purpose. Similarly, the outer body O is connected at its lower end to the fishing tool attachment A and fish F and to this end is provided with threaded means referred to at 9A.

Seal means 20 spaced longitudinally from the seal means 15 form second chamber means 22 for receiving a compressible medium of any suitable type, such as nitrogen, therein.

Figure 9:
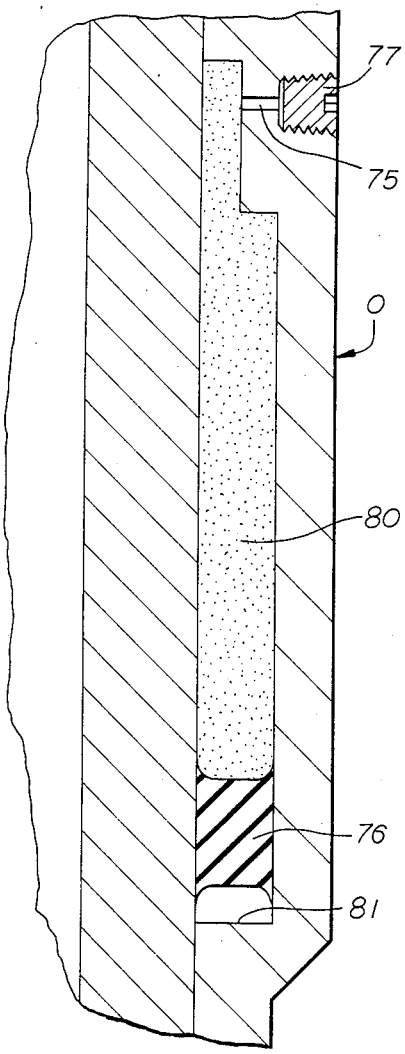
FIG. 9 illustrates the details of a lubricant chamber.

A third chamber is provided for receiving a lubricant for lubricating the outer surface of said inner body I and the upper seal means 20 adjacent the upper end of the outer body O and between it and the inner body I. The third chamber is formed by a recess 80 as shown in FIG. 9 formed in the outer body O, and a seal means 76 is positioned adjacent the end 81 of the chamber 80 and in spaced relation to the seal means 20 as shown in greater detail in FIG. 9. The seal means 76 may be formed of a single piece of elastomer sealably engaging between the inner and outer bodies I, O, as shown, or in any other desired manner. An opening forming a lubricant or grease fitting is provided in the outer body O for receiving lubricant therethrough and then may be provided with the plug 77 in a well known manner.

Suitable port means are provided in each chamber 18 and 22 in the outer body O for charging the respective chambers 18 and 22 with the operating liquid and the compressible fluid medium. Such ports are not shown as this structural detail is well known to those skilled in the art.

The hydraulic jar mechanism JH illustrated in FIGS. 1A and 1B and 4–7 includes cooperating means referred to generally by the numeral 25 on the inner and outer bodies I, O, respectively, within the first chamber means 18 which are operable by movement of the well string S and inner body I relative to outer body O to actuate or position the cooperating means 25 for restraining longitudinal movement between the inner and outer bodies, I, O, to a relative extended position whereby a pull force may be developed in the well string. The cooperating means 25, as will be described in greater detail hereinafter, is further operable after a predetermined relative longitudinal movement between the inner and outer bodies I, O, in response to the pull force in the well string S, to release the cooperating mechanism 25 and hence the inner and outer bodies I, O, for subsequent unrestrained relative longitudinal movement therebetween until the jarring surfaces 26, 27 on the inner body I and outer body O, respectively, engage with each other to deliver an upward jar to the well string.

The cooperating means 25 may be referred to by various terminology such as a piston and restricted body, fluid meter means or restricted flow means. In a hydraulic jar, the cooperating means 25 comprises an arrangement to enable the inner body I and outer body O to move longitudinally relative to each other in an unrestricted manner in one direction, and since the invention is described in relation to its use with an up jar, the unrestrained relative movement in the embodiment shown in FIGS. 1A–2 and 4–7 would occur when the well string S is lowered to lower the inner body I longitudinally and telescopically into the outer body O until a predetermined position of the cooperating means 25 on the inner body I and outer body O is reached. When this position is reached, the cooperating means 25 functions to restrain relative longitudinal movement between the inner body I and outer body O in the opposite direction, and in the embodiment illustrated in FIGS. 1A–2 and 4–7, in an upward direction so that a pull force is developed in the well string S and connected inner body I by hoisting means at the earth's surface. A predetermined pull force on the well string will gradually move the inner member I upwardly in a restricted manner relative to the outer body O until a predetermined position is reached of the cooperating means 25 whereupon further upward movement of the inner body I and well string S is rapid in response and unrestrained to the pull in the well string so that an upward jar is delivered to the well string S and the stuck fish F when the jarring surface 26 on the inner body I impinges against the jarring surface 27 on the outer body O.

Figure 1A:
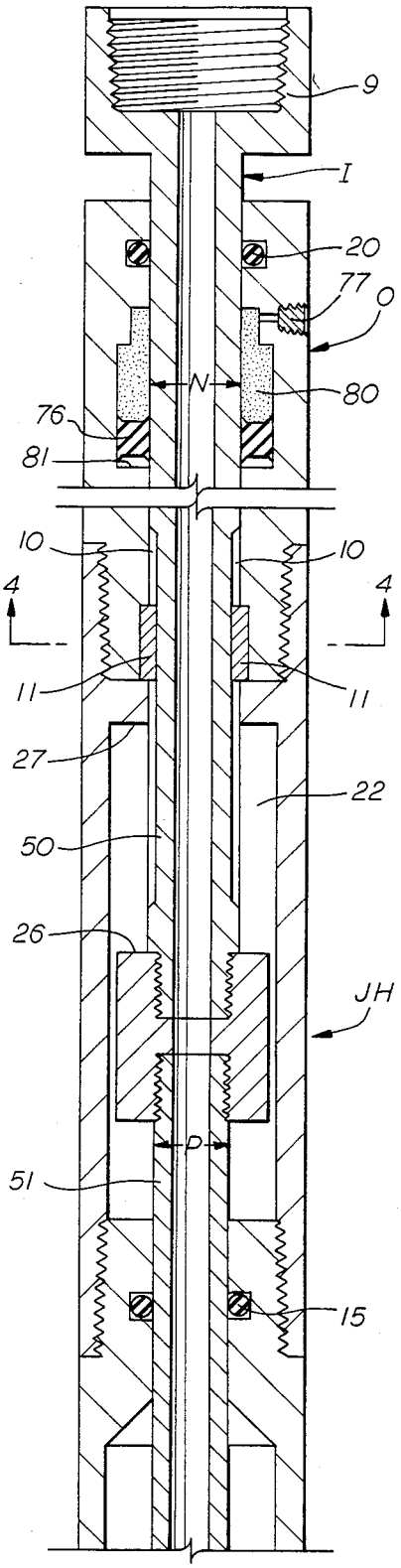
FIG. 1A is a longitudinal vertical sectional view illustrating an embodiment of the present invention as employed with a form of a hydraulic jar.
Figure 1B:
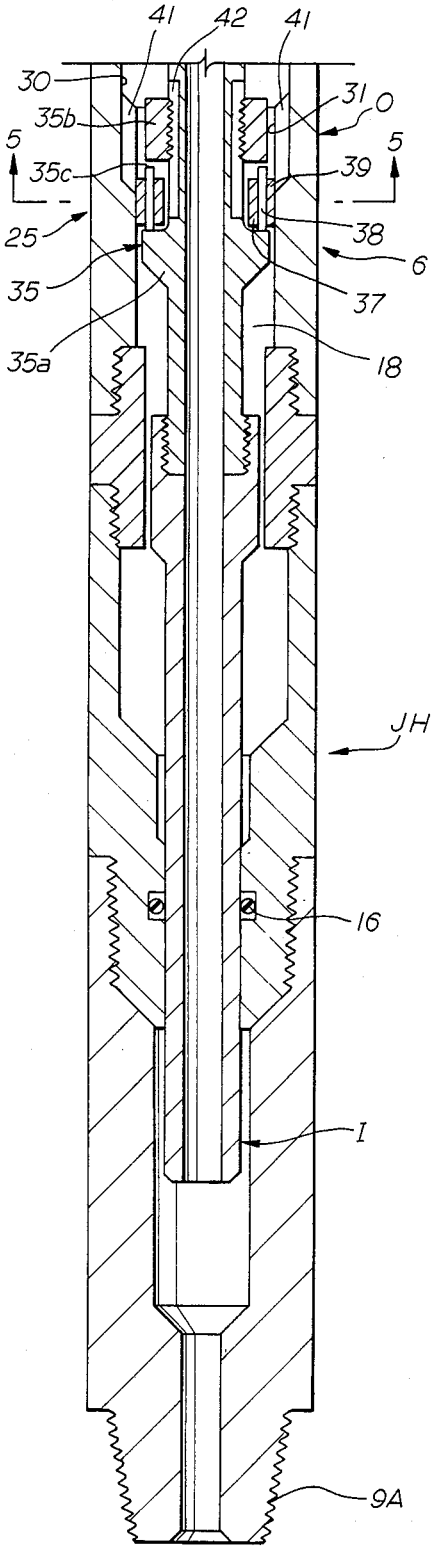
FIG. 1B is a continuation of FIG. 1A illustrating further details of a hydraulic jar mechanism which may be used with the present invention.
Figure 6:
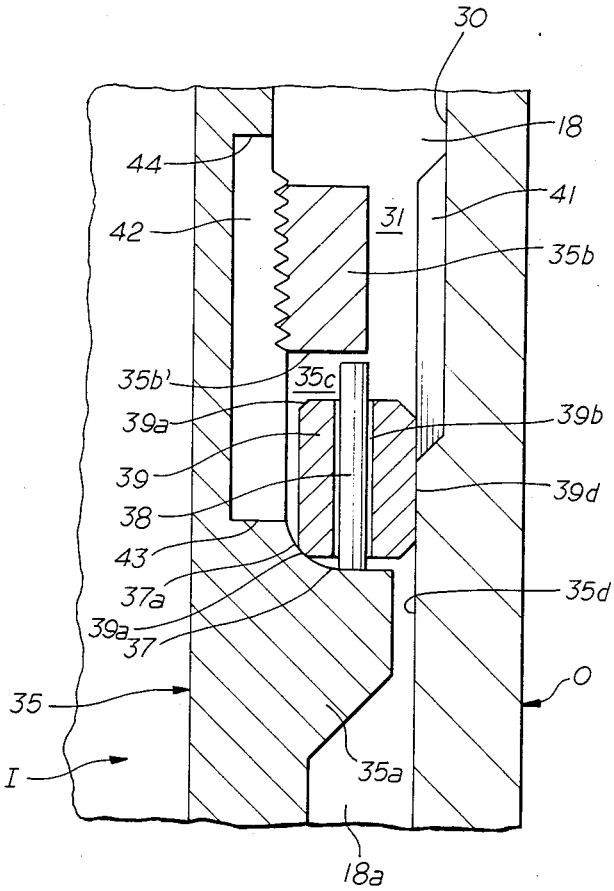
FIG. 6 is a partial longitudinal sectional view of the portion of the tool indicated at 5—5 in FIG. 1B and showing in greater detail the arrangement of a metering means on the inner and outer bodies forming the hydraulic jar arrangement shown in FIG. 5.

The cooperating means 25 in FIGS. 1B and 6 of the drawings, for purposes of explanation only, is shown as including an enlarged bore 30 formed by the wall of outer body O in the upper end of chamber 18. A piston means 35 carried by inner body I includes spaced annular portions **35*a*, 35*b* providing annular space 35*c* therebetween. The annular clearance between piston portions 35*a*, 35*b* and the wall of outer body O forms annular restricted bore 31 which communicates the lower end portion 18*a* of chamber 18 with the enlarged bore 30 in the upper end of chamber 18. Piston ring 39 includes bores 39*b* for receiving metering pins 38 mounted on piston portion 35*a* and extending upwardly to terminate adjacent, but in spaced relation to portion 35*b* which is shown as being threadedly secured to inner member I. Circumferentially spaced grooves 41 formed in the wall of outer body O extend from adjacent one end of enlarged bore 30 into restricted bore 31 and terminates between piston portions 35*a*, 35*b* when members or bodies I and O are in the longitudinal relationship shown in FIG. 6. Circumferentially spaced grooves 42 on inner body I terminate at 43, 44, respectively, and span piston portion 35*b* so that liquid may flow upwardly freely from the lower end portion 18*a* of chamber 18 through restricted bore 31 to enlarged bore 30 above piston portion 35*b***.

When the well string S and connected inner body I are lowered, operating liquid beneath piston portion **35*a* in chamber portion 18*a* flows into the restricted bore around piston portion 35*a* and moves piston ring 39 up on pins 38 until it strikes surface 35*b*′ on piston portion 35*b*. Operating liquid flows around and under piston ring 39 into grooves 41, 42 through restricted bore 31 to enlarged bore 30 of chamber 18 above piston portion 35*b* and piston ring 39. When well string S and body I are lowered to the desired position in restricted bore 35*c*, an upward pull on well string S will cause piston ring 39 to slide down on pins 38 to the position of FIG. 6 so that annular surface 39*d* of piston ring 39 slidably engages outer wall surface 35*d* in restricted bore 31. When a pull is exerted on the inner body I of the well string, piston ring beveled edge 39*a* seats on curved portion 37*a* of surface 37 of piston portion 35*a* as shown in FIG. 6**.

When piston ring 39 is positioned as shown in FIG. 6 and while an upward pull is placed on the well string S and inner body I, the operating liquid can only pass or escape from enlarged bore 30 at the upper end of chamber 18 through the metering passages **39*b* above the piston means 35 to the lower end portion 18*a* of chamber 18 beneath piston means 35 as long as piston 39 slidably engages wall 35*d*. This restricts the liquid flow and enables a substantial pull force to be developed in the well string S while endeavoring to effect release of the piston means 35 from restricted bore 31** as will be described.

Means on the inner body I form a differential area which compresses the compressible medium in the second chamber 22 as the body I is lowered to set, actuate or cock the hydraulic or mechanical jar cooperating means 25 for delivering an upward jarring force to the drill or well string. The means forming a differential area on the inner body I comprises a first longitudinally extending portion 50 having a diameter represented at N in FIG. 1A which sealably and slidably engages the upper seal means 20 and 76 defining the compressible medium receiving chamber 22 and a longitudinally extending second portion 51 having a diameter represented at P which is smaller than the diameter N which slidably and sealably engages the seal means 15 defining the lower end of the compressible medium receiving chamber 22.

The difference in the diameter of the first and second portions on the inner member in fluid receiving chamber 22 provides a differential area which is responsive to the compressed medium, or on which the compressed medium in chamber 22 may act when the jar JH is released and while the pull force is cooperating with the external mass DC to increase the jarring impact.

As shown in the drawings, by way of example only, the first portion 50 and the second portion 51 are both formed on the inner body I; however, the components may be arranged so that such portions could as readily be provided on the outer body O.

Thus, as the inner body I is telescopically lowered to position the hydraulic jar means and create a hydraulic lock or restraint so that an upward pull force may then be developed in the well string, the first longitudinally extending portion 50 on inner body I will have moved to a position in chamber 22 so that the differential area compresses the fluid in the fluid medium receiving chamber 22.

Thereafter, an upward pull force is developed in the well string and inner member to actuate or release the hydraulic jar mechanism by pulling piston 35 upwardly to a position so that operating fluid may move freely from enlarged chamber 30 around piston 35 to end portion **18*a* beneath piston 35. This accommodates unrestrained or free relative longitudinal movement between the inner body I and outer body O, so that the energy resulting from the pull force developed in the well string delivers an up jar to the well string. The compressed medium in chamber 22 acting on the differential area formed by the difference in diameter of the larger diameter portion 50 as compared with the smaller diameter portion 51** assists in increasing the upward jar energy that is imparted to the well string. Such increase may be assisted by increasing the mass of the drill collars DC without altering the jar structure.

Figure 7:
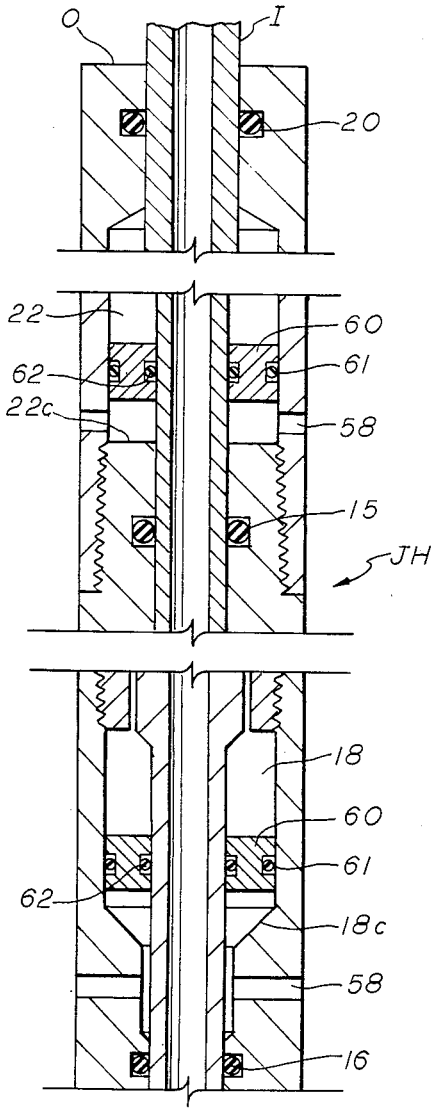
FIG. 7 is a partial vertical sectional view of another embodiment of the present invention illustrating means to equalize pressure in the well bore with the pressure in the operating liquid chamber of the hydraulic jar and means for equalizing pressure in the compressible medium chamber.

In FIG. 7, means are provided for equalizing the pressure in the well bore with the pressure in the operating liquid chamber 18 and in the compressible medium receiving chamber 22. Such means includes the annular ring 60 having seal means 61 and 62 for sealably and slidably engaging each the inner and outer bodies I and O, respectively. It will be noted that the ring 60 may be employed in either or both of the chambers 18 and 22, and as shown in FIG. 7, is employed in both of such chambers. It is preferably positioned adjacent the lowermost end 22*c* of the upper chamber and lowermost end 18*c* of the lower chamber, and the outer body O is provided with an opening 58 between each seal ring 60 and the adjacent end 18*c*, and 22*c* of the first and second chamber means, respectively.

Figure 8:
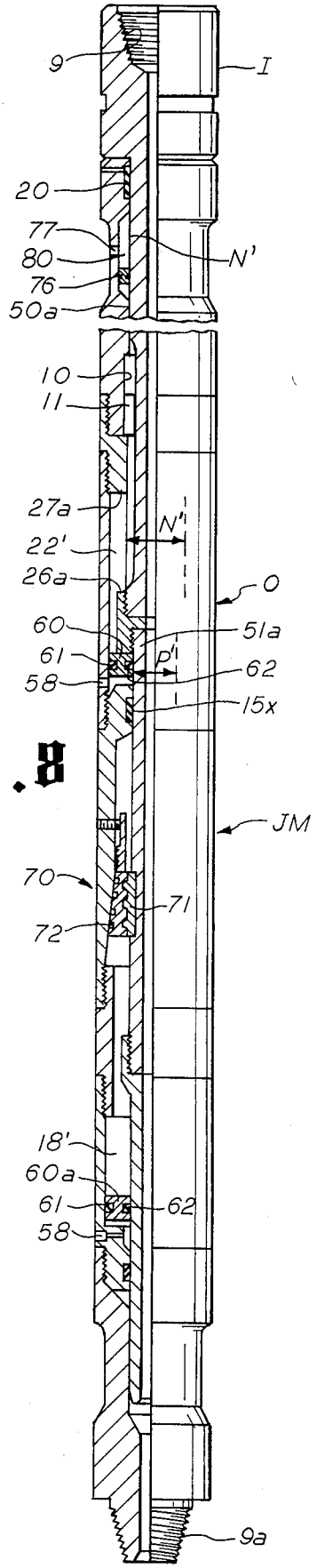
FIG. 8 illustrates a specific embodiment of a mechanical jar in which the present invention can be employed.

FIG. 8 illustrates the use of the present invention in conjunction with a jarring mechanism JM such jarring mechanism JM assumes a mechanical arrangement. The inner body I is telescopically arranged within the outer body O. Longitudinally spaced upper seal means 15*x* and the lower floating seal referred to at 60*a* define a first chamber 18' which seals off the operating mechanical jar mechanism referred to generally by the numberal 70. Means 10 and 11, as described with regard to FIGS. 1, 2 and 4–7, prevent relative rotation while accommodating longitudinal movement between bodies I and O. A third or lubricant chamber may also be provided as shown in the drawings.

The longitudinally spaced seal means 20 and floating seal ring 60 define a second chamber 22' for receiving a compressible medium therein. The mechanical engageable jar means 70 include slip engaging means 71 on the inner member I and expandable slip means 72 in a bowl on the outer body O. The construction and details of a mechanical jar are also well known, one of such constructions being shown in U.S. Pat. No. 3,880,249 issued on Apr. 29, 1975. When the slip engaging means 71 is mechanically engaged with the expandable slip means 72 as illustrated in FIG. 8 of the drawings, an upward pull force may be developed in the well string connected to the upper end of the inner member I in a manner well known in the art. The engagement of the means 71, 72 restrains relative longitudinal movement between the inner body I and outer body O to enable the desired pull force to be developed in the well string, but such mechanically engageable means 70 disengages when the predetermined pull force has been reached so that the inner member I and slip engaging means 71 move unrestrained upwardly out of the expandable slip means 72 carried by outer member O for unrestrained longitudinal movement between the inner and outer bodies I, O.

The inner body I is provided with means forming a differential area on the inner body I within the compressible medium chamber 22', which differential pressure area compresses the compressible medium in the chamber 22' as the well string and the inner body I are lowered to engage the mechanical jar mechanism as shown in FIG. 8 of the drawings. When the jar mechanism releases to accommodate unrestrained longitudinal movement of the inner body I relative to the outer body O, the compressed gas in chamber 22' acts on the differential area to assist in applying the upward jar to the well string. The differential area on the inner body I comprises a first longitudinally extending portion 50*a* on the body I having a diameter represented at N' which sealably and slidably engages the upper seal means 20 of the chamber 22'. A second longitudinally extending portion 51*a* on member I sealably and slidably engages seal 15*x* and has an outer diameter represented at P' which is smaller than the outer diameter of first longitudinally extending portion 50*a* thereby providing a differential area on the inner member I upon which the compressed gas is effective in a manner as described with regard to FIGS. 1–2 and 4–7.

The operation of the invention when it is employed with a mechanical jar JM is the same as that described with regard to a hydraulic jar in that the inner body I is manipulated to engage the mechanical jarring mechanism 70 when it is desired to apply an upward jar force to the well string. Thereafter, relative longitudinal movement between outer body O and inner body I is restrained while a pull force is developed in the well string S which eventually effects actuation of the jar mechanism to release 71, 72 with releases inner body I for unrestrained longitudinal movement relative to outer body O. Since inner body I can be manipulated to engage the jar mechanism by moving inner body I downwardly relative to outer body O, the gas in chamber 22' can be compressed by the differential area between 50*a* and 51*a* represented by N' and P', respectively. When the pull force releases the mechanical jar, the compressed gas in chamber 22' is then operative upon the differential area of inner body I to assist in applying an upward jarring force.

Figure 2:
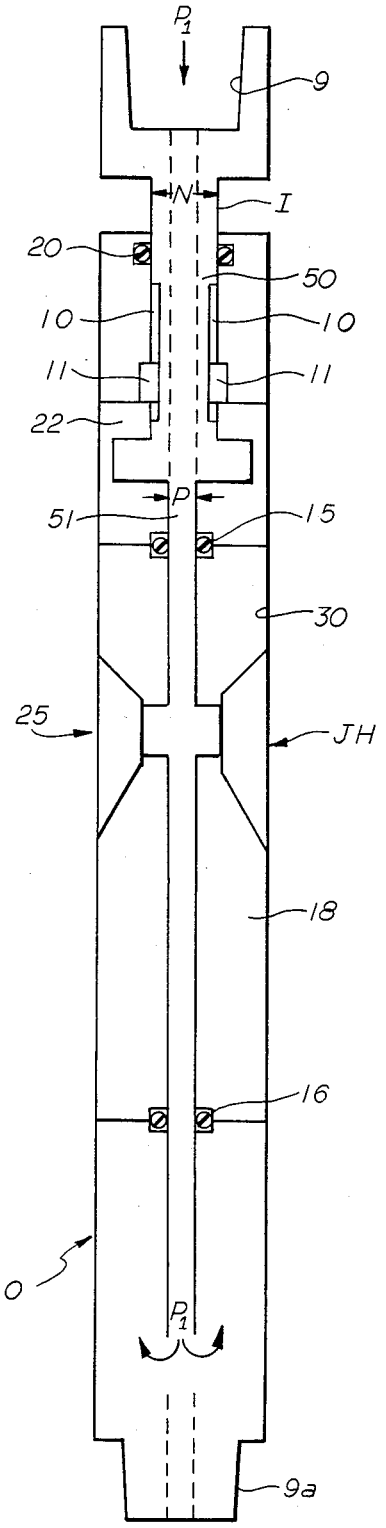
FIG. 2 is a schemetic view of the embodiment illustrated in FIGS. 1A and 1B demonstrating the differential areas in the tool of the present invention which are responsive to first compress the gas in the chamber as the hydraulic jar is set, and which is thereafter responsive to the compressed gas to assist in delivering a jar blow to the well string when the jar is released by a pull force.

In summary, for an ordinary up jar tool, the energy available $E_1$ for the jar impact is the average amount of force placed on the jar through the pipe string from the surface times the free stroke displacement of the jar minus the gravitational effect on the jar weight W in FIG. 2:

$$E_1 = \frac{F_1(L)}{2} - \frac{WV_2}{2g} \text{ where}$$

$F_1$ = Max. jar pull
$L$ = Free or unrestrained stroke of jar
$W$ = Drill collar weight above jar
$g$ = Acceleration of gravity
$V$ = Velocity of $W$
$E_1$ = Jar energy available from surface pull With the present invention, an additional energy, $E_2$, is made available by charging the chambers 22, 22' with a compressible fluid and by imparting weight W of drill sring as the jar is cocked due to gravity. The added available energy $E_2$ is: the average force of compression times the free stroke of the jar:

$$E_2 = \frac{F_2 \times (L)}{2} \text{ where } F_2 = P_1 - P_2[A_1 - A_2]$$

$$E_2 = \frac{P_1 - P_2(A_1 - A_2)}{2} \times L \text{ where}$$

$P_1$ = Initial chamber charge
$P_2$ = Final chamber pressure
$A_1 - A_2$ = Differential area
$E_2$ = Added available energy from the average force of compression times jar free stroke Therefore if $A_1$-$A_2$ and the final charge pressure $P_2$ of compressible medium in chamber 22 or 22' is sufficiently large, then the total available energy to perform jarring work, $E_3$ (total jar energy available) can be greatly increased by the present invention, that is, $$E_3 = E_1 + E_2 - \frac{WV^2}{2g}.$$

The energy $E_1$ available for jarring conventionally is dependent on strain contraction of the whole or significant amount of the well string. Whereas the additional energy $E_2$ of this invention adds to the available total energy from the bottom of the jar string and is not totally dependent on contraction of the pipe string above the jar, but supplements the strain contraction energy of conventional jar systems.

An additional important part of the present invention resides in the fact that the gravitational weight of the drill collar string of FIG. 3 and additional amounts of the total pipe string is used to store energy in the form of $E_2$ which is subsequently used in the up jar impact by virtue of the way a conventional jar system and the present invention combine to convert a heretofore unused energy quantity to contribute to up jar impact.

Since the system is contained in a single unit and the charge pressure generates a force opposing closing of the jar, a new setting mode is provided whereby the jar timing for impact jarring can be easily controlled from the well surface by the operator.

Shaft portion 50 or 50*a* can be made sufficiently larger than shaft portion 51 or 51*a* so that when the portion 50 is lowered, substantial resistance would be offered by the compressible medium which acts on the differential area therebetween. Thus, when the jarring cooperating mechanism 25 is released so that the inner member may move up in response to the pull force developed in the well string, the compressed medium in chamber 22 exerts considerable additional upward force and is controlled by the operator.

The foregoing disclosure and description of the invention are illustrative and explanatory thereof, and various changes in the size, shape and materials as well as in the details of the illustrated construction may be made without departing from the spirit of the invention.

We claim:

1. A compressible medium assisted hydraulic jar arrangement for incorporating in a well string for use in a well bore to deliver an upward jar to the well string, comprising:

an outer body adapted to be connected to a stuck fish in the well bore;

a hollow inner body for connecting with the well string and telescoped within said outer body and longitudinally movable relative thereto;

jarring surfaces on said inner and outer bodies for jarring contact with each other to deliver an upward jar to the well string;

spaced upper and lower seal means between said inner and outer bodies forming first chamber means for receiving an operating liquid;

longitudinally extending annular restriction means on said outer body within the first chamber;

piston means secured to and movable with said inner body within the first chamber;

said piston means including fluid meter means operable when said piston means is between the ends of said restriction means for restraining longitudinal movement of said inner body to an extended position relative to said outer body whereby a pull force may be developed in the well string and inner body, said fluid meter means operable after a predetermined relative longitudinal movement between said inner and outer body in response to the pull force in the well string and inner body to release said inner body for subsequent unrestrained longitudinal movement relative to said outer body until said jarring surfaces engage and deliver an upward jar to the well string;

additional spaced upper and lower seal means between said inner and outer bodies forming second chamber means for receiving a compressible medium therein; and means forming a differential area on said inner body within the second chamber which compresses the compressible medium in the second chamber as the well string and inner body are lowered to telescope said inner body into said outer body for positioning said piston means in the first chamber to restrain movement between said inner and outer body to the extended position, and said differential area responsive to the compressible medium in the second chamber to exert an upward force on said inner body to assist in applying the upward jar to the well string when said inner body is released from said outer body by the pull force in the well string for unrestrained longitudinal movement therebetween.

2. A compressible medium assisted hydraulic jar for incorporating in a well string for use in a well bore comprising:

inner and outer telescopically arranged bodies movable longitudinally relative to each other;

longitudinally spaced seal means between said inner and outer bodies forming, respectively, a first chamber for receiving an operating liquid and a second chamber for receiving a compressible medium therein;

jarring surfaces on said inner and outer bodies for jarring contact with each other to deliver an upward jar to the well string;

hydraulic jar means formed by cooperating means on said inner and outer bodies within the first chamber, said cooperating means operable by movement of the well string for restraining longitudinal movement between said inner and outer bodies to an extended position whereby a pull force may be developed in the well string, said cooperating means further operable after a predetermined relative longitudinal movement between said inner and outer bodies in response to the pull force in the well string to release said inner and outer bodies in response to the pull force in the well string for subsequent unrestrained relative longitudinal movement therebetween until said jarring surfaces engage with each other to deliver an upward jar to the well string;

means forming a differential area on one of said bodies within the second chamber which compresses the compressible medium in the second chamber as the well string is lowered to position said cooperating means on said inner and outer bodies within the first chamber for restraining relative longitudinal movement therebetween, said differential area responsive to the compressible medium in the second chamber to exert an upward force on said differential area on said one body to assist in applying the upward jar to the well string when said inner and outer bodies are released in response to the pull force in the well string for unrestrained relative longitudinal movement therebetween.

3. A compressible medium assisted mechanical jar arrangement for incorporating in a well string for use in a well bore to deliver an upward jar to the well string, comprising:

an outer body adapted to be connected to a stuck fish in the well bore;

a hollow inner body for connecting with the well string and telescoped within said outer body and longitudinally movable relative thereto;

jarring surfaces on said inner and outer body for jarring contact with each other to deliver an upward jar to the well string;

spaced upper and lower seal means between said inner and outer bodies forming, respectively, first chamber means for receiving an operating liquid and a second chamber for receiving a compressible medium;

mechanically engageable means comprising slip engaging means and expandable slip means respectively on said inner and outer bodies engageable when the well string is lowered for restraining longitudinal movement of said inner body to an extended position relative to said outer body whereby a pull force may be developed in the well string and inner body, said mechanical engaging means operable after a predetermined pull force is developed in the well string and inner body to release said inner body for subsequent unrestrained longitudinal movement relative to said outer body until said jarring surfaces engage and deliver an upward jar to the well string;

means forming a differential area on said inner body within the second chamber which compresses the compressible medium in the second chamber as the well string and inner body are lowered to engage said mechanical engaging means to restrain movement between said inner and outer body to the extended position, and said differential area responsive to the compressible medium in the second chamber to exert an upward force on said inner body to assist in applying the upward jar to the well string when said inner body is released from the outer body by the pull force in the well string.

4. The invention of claims 1 or 3 wherein said means forming a differential area on said inner body comprises a first longitudinally extending portion which sealably and slidably engages the upper of said spaced seal means between said inner and outer bodies in the second chamber and a longitudinally extending second portion having a smaller diameter than said first portion which sealably and slidably engages the lower of the seal means in the second chamber.

5. A compressible medium assisted mechanical jar for incorporating in a well string for use in a well bore comprising:

inner and outer telescopically arranged bodies movable longitudinally relative to each other;

longitudinally spaced seal means between said inner and outer bodies forming, respectively, a first chamber for receiving an operating liquid and a second chamber for receiving a compressible medium;

jarring surfaces on said inner and outer bodies for jarring contact with each other to deliver in an upward jar to the well string;

mechanical jar means formed by cooperating means on said inner and outer bodies within the first chamber, said mechanically engageable means engageable by movement of the well string to restrain relative longitudinal movement between said inner and outer bodies to an extended position whereby a pull force may be developed in the well string, said engageable means operable in response to the pull force in the well string to release said inner and outer bodies for subsequent unrestrained relative longitudinal movement therebetween until said jarring surfaces engage with each other to deliver an upward jar to the well string;

means forming a differential area on one of said bodies within the second chamber which compresses the compressible medium in the second chamber as the well string is lowered to position said engageable means on said inner and outer bodies within the first chamber, said differential area responsive to the compressible medium in the second chamber to exert an upward force on said differential area on said one member to assist in applying the upward jar to the well string when said inner and outer bodies are released in response to the pull force in the well string for unrestrained relative longitudinal movement therebetween.

6. The invention of claims 1, or 2, or 3, or 5 including means connecting said inner and outer bodies to prevent relative rotation therebetween.

7. The invention of claims 1, or 2, or 3, or 5 including means to equalize pressure adjacent an end of the first chamber means with the pressure in the well bore.

8. The invention of claims 1, or 2, or 3, or 5 including means to equalize pressure adjacent an end of the second chamber means with the pressure in the well bore.

9. The invention of claims 1, or 2, or 3, or 5 including means to equalize pressure adjacent an end of each the first and second chamber means with the pressure in the well bore.

10. The invention of claims 1, or 2, or 3, or 5 including means to equalize pressure in each the first and second chamber means, said pressure equalizing means comprising:

movable seal means adjacent one end of each the first and second chamber means and sealably engaging said inner and outer bodies; and said outer body having passage means between said movable seal means and the adjacent end of each the first and second chamber means for communicating well bore pressure to act on said movable seal means.

11. The invention of claims 1, or 2, or 3, or 5 including means to equalize pressure in the first chamber with the pressure in the well bore, said pressure equalizing means comprising:

movable seal means adjacent one end of the first chamber means and sealably engaging said inner and outer bodies; and said outer body having passage means between said movable seal means and the adjacent end of the first chamber means for communicating well bore pressure to act on said movable seal means.

12. The invention of claims 1, or 2, or 3, or 5 including means to equalize pressure in the second chamber with the pressure in the well bore, said pressure equalizing means comprising:

movable seal means adjacent one end of the second chamber means and sealably engaging said inner and outer bodies; and said outer body having passage means between said movable seal means and the adjacent end of the second chamber means for communicating well bore pressure to act on said movable seal means.

13. The invention of claims 1, or 2, or 3, or 5 wherein the lower seal means forming the second chamber comprises floating seal means sealably engaged with said inner and outer bodies, and wherein said outer body is provided with an opening between said floating seal means and the adjacent chamber end for communicating well bore pressure to the chamber.

14. The invention of claims 1, or 2, or 3, or 5 including means in the second chamber connecting said inner and outer bodies to prevent relative rotation therebetween.

15. The invention of claims 1, or 2, or 3, or 5 including additional seal means between said inner body and outer body forming a lubricant receiving chamber for providing lubricant to the outer surface of said inner body and the upper seal means of the second chamber.

16. The invention of claims 1, or 2, or 3, or 5 including seal means between said inner body and outer body forming a lubricant receiving chamber for providing lubricant to the outer surface of said inner body and the upper seal means of the second chamber wherein said additional seal means comprises movable seal means adjacent, but spaced from said upper seal means in the second chamber, said movable seal means sealably engaging said inner and outer bodies and responsive to the compressible medium in the second chamber.

17. In a hydraulic jar comprising an outer body adapted to be connected to a stuck fish in a well, an inner body telescoped within the outer body and longitudinally movable relative thereto, jarring surfaces on the bodies for jarring contact with each other, an operating liquid chamber formed between the inner and outer bodies, a restricted bore provided in the outer body and disposed in the liquid chamber, a piston assembly on the inner body adapted to be lowered into position in the restricted bore whereby a high pull may be developed on the inner body to move the piston assembly into a larger portion of the outer body for releasing the inner body and enabling the jarring surfaces to contact each other with an upward jarring blow which is imparted to the stuck fish connected to the outer body, the invention of a compressible medium means for assisting the hydraulic jar in applying an upward jar to the well string comprising:

spaced upper and lower seal means between the inner and outer bodies forming a compressible medium receiving chamber for receiving a compressible medium therein; and means forming a differential area on the inner body which compresses the compressible medium in the compressible medium chamber as the well string and inner body are lowered to telescope the inner body into the outer body for positioning the piston assembly in the restricted bore to develop the high pull in the well string, and said differential area responsive to the compressible medium in the chamber to exert an upward force on the inner body to assist in applying the upward jarring blow to the well string and stuck fish when the inner body is released by the pull force on the well string.

18. In a hydraulic jar wherein a hydraulic up jar is incorporated on inner and outer bodies in the well string, the invention of a compressible medium means for assisting the hydraulic jar in applying an upward jar to the well string comprising:

spaced seal means between the inner and outer bodies forming a chamber for receiving a compressible medium therein; and means forming a differential area on one of the bodies within the chamber which compresses the compressible medium in the chamber as the well string is lowered to position the inner and outer bodies so that the hydraulic jar is actuated to restrain relative longitudinal movement between the inner and outer bodies to an extended position whereby a pull force may be developed in one of the bodies whereupon the hydraulic jar, in response to a predetermined pull force, releases the bodies for contact to apply an up jarring force to the well string, said differential area responsive to the compressible medium in the chamber to exert an upward force on said differential area to assist in applying the upward jar to the well string when the inner and outer bodies are released.

19. The invention of claims 2, or 4, or 17, or 18 wherein said means forming a differential area is formed on the inner body.

20. The invention of claims 2, or 4, or 17, or 18 wherein said means forming a differential area is formed on the inner body by the difference in area between a first longitudinally extending portion which sealably and slidably engages one of the spaced seal means between the inner and outer bodies in the compressible medium receiving chamber and a longitudinally extending portion on the inner body having a smaller diameter than said first portion which sealably and slidably engages the other of said seal means forming the compressible medium receiving chamber.

21. In a device for use with a jar mechanism incorporated on inner and outer bodies in a well string to assist in delivering an upward jar to the well string, the invention of a compressible medium means for assisting the jar mechanism in applying an upward jar to the well string comprising:

longitudinally spaced seal means between the inner and outer bodies forming a chamber for receiving a compressible medium therein; and means forming a differential area on one of the bodies within the compressible medium chamber which compresses the compressible medium in the chamber as the well string is lowered to position the inner and outer bodies so that the jar mechanism is actuated to restrain relative longitudinal movement between the inner and outer bodies to an extended position whereby a pull force may be developed in the well string and one of the bodies whereupon the jar mechanism, in response the pull force, releases the bodies for contact to apply an up jar force to the well string, said differential area responsive to the compressed medium in the chamber to exert an upward force on sad differential area to assist in applying the upward jar to the well string when the inner and outer bodies are released.

22. The invention of claim 21 wherein the jar mechanism is hydraulically actuated.

23. The invention of claim 21 wherein the jar mechanism is mechanically actuated.

24. In a mechanical jar comprising an outer body adapted to be connected to a stuck fish in the well, an inner body telescoped within the outer body and longitudinally movable relative thereto, jarring surfaces on the bodies for jarring contact with each other, an operating liquid chamber formed between the inner and outer bodies, mechanically engageable means on said inner and outer bodies engageable when the well string is lowered to restrain relative longitudinal movement between the inner and outer bodies to an extended position whereby a high pull may be developed on the inner body, the engageable means disengaging when a predetermined pull force is applied to the inner body to release the inner body and enabling the jarring surfaces to contact each other with an upward jarring blow which is imparted to the stuck fish connected to the outer body, the invention of a compressible medium means for assisting the mechanical jar in applying an upward jar to the well string comprising:

spaced upper and lower seal means between the inner and outer bodies forming a compressible medium receiving chamber for receiving a compressible medium therein; and means forming a differential area on the inner tubular body which compresses the compressible medium in the compressible medium receiving chamber as the well string and inner body are lowered to telescope the inner body into the outer body for positioning the piston assembly in the restricted bore to develop the high pull in the well string, and said differential area responsive to the compressible medium in the chamber to exert an upward force on the inner body to assist in applying the upward jarring blow to the well string and stuck fish when the inner body is released by the pull force on the well string.

25. The invention of claims 17, or 18, or 21, or 24 including means connecting said inner and outer bodies to prevent relative rotation therebetween.

26. The invention of claims 17, or 18, or 21, or 24 including means to equalize pressure adjacent an end of the compressible medium receiving chamber with the pressure in the well bore.

27. The invention of claims 17, or 18, or 21, or 24 wherein said means to equalize pressure includes:

movable seal means adjacent an end of the compressible medium receiving chamber and sealably engaged with the inner and outer bodies; and the outer body having passage means between said movable seal means and the adjacent end of the compressible medium receiving chamber for communicating well bore pressure to act on said movable seal means.

28. The invention of claims 17, or 18, or 21, or 24 wherein said means forming a differential area on the inner body comprises a first portion on the inner body which slidably and sealably engages the upper of said spaced seal means in the compressible fluid receiving chamber and a second longitudinally extending portion having a smaller diameter than said first portion which slidably and sealably engages the lower of the spaced seal means in the compressible fluid receiving chamber.

29. The invention of claims 17, or 18, or 21, or 24 including means in the compressible medium receiving chamber for connecting said inner and outer bodies to prevent relative rotation therebetween.

30. The invention of claims 17, or 18, or 21, or 24 wherein the lower seal means forming the compressible medium receiving chamber comprises floating seal means sealably engaged with the inner and outer bodies, and wherein the outer body is provide with an opening between said floating seal means and the adjacent chamber end for communicating well bore pressure to the chamber.

31. The invention of claims 17, or 18, or 21, or 24 including additional seal means between the inner and outer bodies forming a lubricant receiving chamber for providing lubricant to the outer surface of the inner body and said upper seal means of the compressible medium receiving chamber.

32. The invention of claims 17, or 18, or 21, or 24 including additional seal means between the inner and outer bodies forming a lubricant receiving chamber for providing lubricant to the outer surface of the inner body and said upper seal means of the compressible medium receiving chamber and wherein said additional seal means comprises movable seal means adjacent, but spaced from said upper seal means in the compressible medium receiving chamber, said movable seal means sealably engaging the inner and outer bodies and responsive to the compressible medium in the compressible medium receiving chamber.

33. The invention of claims 2, or 3, or 5 or 17, or 18, or 21 or 24 wherein said means forming a differential area is formed by the difference in area between a first longitudinally extending portion which sealably and slidably engages one of said spaced seal means between the inner and outer bodies in the compressible medium receiving chamber and a longitudinally extending second portion having a smaller diameter than said first portion which sealably and slidably engages the other of said seal means forming the compressible medium receiving chamber.

34. A method of manipulating a jar mechanism incorporated on relative longitudinally movable inner and outer bodies in a well string and having a differential area on one of the bodies responsive to a compressible medium in a sealed chamber between the inner and outer bodies for delivering an upward jar impact to the well string comprising the steps of:

moving the well string to effect engagement of the jar mechanism and to move the differential area in the chamber to compress the compressible medium therein; and applying a pulling force on the well string while the jar mechanism is engaged to place the well string in tension for developing a pull force therein which releases the jar mechanism and accommodates unrestrained relative longitudinal movement between the inner and outer bodies in response to the pulling force developed in the well string and the compressible medium acting on the differential area to apply an upward jar impact to the well string.

35. In a well string jar mechanism for delivering an up jar impact to a stuck fish in a well bore wherein the jar mechanism includes a jarring surface on an outer body connected to the stuck fish, a jarring surface on an inner body connected to the well string and telescoped within the outer body, the jarring surfaces being engageable by exerting a pull on the well string to deliver an up jar impact to the stuck fish, the invention of means to enhance the energy applied by the jar mechanism when the jarring surfaces are engaged including:

longitudinally spaced seal means between the inner and outer bodies forming a chamber for receiving a compressible medium;

means to compress the medium as the inner and outer bodies are moved to cock the jar mechanism to deliver an up jar impact; and means responsive to the compressed medium to enhance the up jar impact delivered to the jarring surfaces when the cocked jar mechanism is released by an up pull on the well string.

36. The arrangement of claim 35 including means carried by the well string externally of the jar mechanism to vary the mass of the means which compresses the medium.

* * * * *